US005218908A

United States Patent [19]

Whitfield

[11] Patent Number: 5,218,908

[45] Date of Patent: Jun. 15, 1993

[54] METHOD FOR CURING AN INK DESIGN ON A CAP

[76] Inventor: Carey Whitfield, 838 Spring Valley Dr., Fredericksburg, Va. 22405

[21] Appl. No.: 931,395

[22] Filed: Aug. 18, 1992

Related U.S. Application Data

[63] Continuation of Ser. No. 695,994, May 6, 1991, abandoned.

[51] Int. Cl.[5] ..... B41F 23/04

[52] U.S. Cl. ..... 101/487; 101/35; 101/424.1; 34/4; 34/39; 392/418

[58] Field of Search ..... 101/487, 488, 35, 416.1, 101/424.1

[56] References Cited

U.S. PATENT DOCUMENTS

| | | | |
|---|---|---|---|
| 1,389,397 | 8/1921 | Tactikos | 392/473 |
| 2,264,814 | 12/1941 | Stanley | 34/99 |
| 2,355,459 | 8/1944 | Miskella | 34/105 |
| 3,102,942 | 9/1963 | Lefebvre | 219/35 |
| 3,118,041 | 1/1964 | Young | 219/19 |
| 3,254,421 | 6/1966 | Kielsmeier et al. | 34/12 |
| 4,266,476 | 5/1981 | Maloof | 101/35 |
| 4,500,773 | 2/1985 | Hanson et al. | 219/215 |
| 4,509,271 | 4/1985 | Tout et al. | 34/12 |
| 4,541,442 | 9/1985 | Hollmann et al. | 132/9 |
| 4,578,880 | 4/1986 | Motev et al. | 34/105 |
| 4,645,649 | 2/1987 | Nagao | 422/186.3 |
| 4,764,662 | 8/1988 | Andersen et al. | 219/391 |

FOREIGN PATENT DOCUMENTS

| | | | |
|---|---|---|---|
| 60-255436 | 12/1985 | Japan . | |
| 738031 | 10/1955 | United Kingdom | 392/416 |

*Primary Examiner*—Edgar S. Burr
*Assistant Examiner*—Lynn D. Hendrickson
*Attorney, Agent, or Firm*—Burns, Doane, Swecker & Mathis

[57] ABSTRACT

A heater for curing an ink design applied to the front surface of a cap comprises an infrared heating unit shaped to generally conform to the horizontal curvature and vertical inclination of the cap front surface. The cap is placed on a tray which is pushed into a heating zone. At the end of a prescribed heating period, the tray is automatically displaced out of the heating zone.

5 Claims, 5 Drawing Sheets

FIG. 7
PRIOR ART
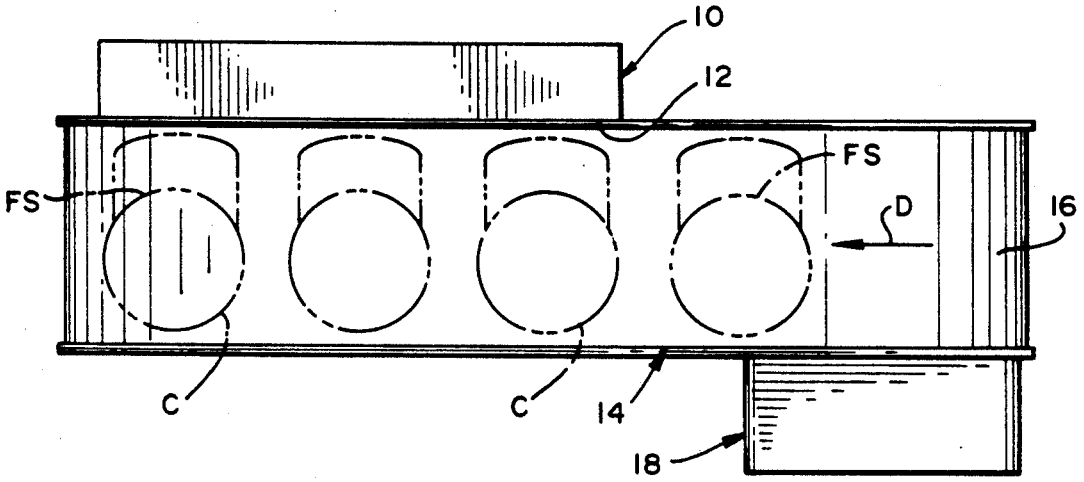
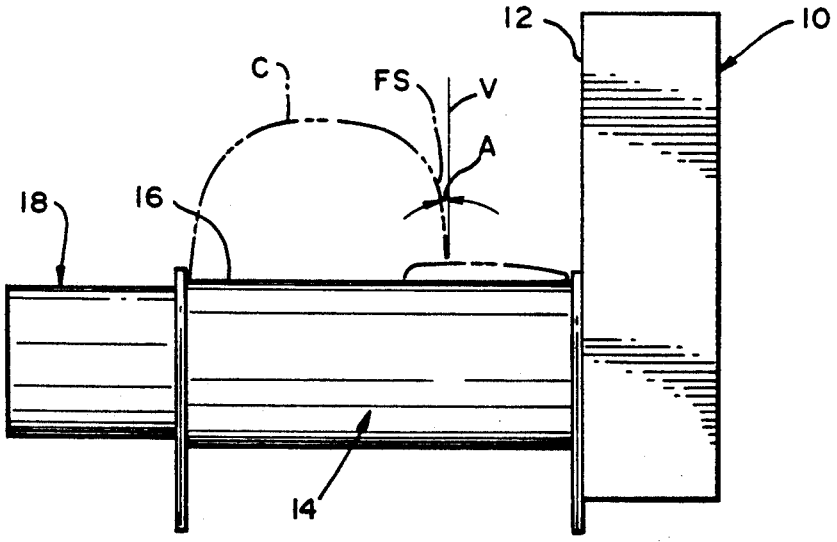
PRIOR ART
FIG 8

METHOD FOR CURING AN INK DESIGN ON A CAP

This application is a continuation of application Ser. No. 07/695,994, filed May 6, 1991 now abandoned.

BACKGROUND OF THE INVENTION

The present invention relates to an apparatus for drying ink designs applied to curved surfaces, especially ink logos imprinted on the front surface of a cap.

It is conventional to apply a logo to the front surface of a cap, such as the application of a team logo to an athletic sporting cap for example. Such logos are typically applied by a silk screen printing process. In order to thereafter cure the ink, it is necessary to heat the ink to its particular curing temperature.

One known apparatus for performing the heating step is depicted in the accompanying FIGS. 7 and 8. That apparatus comprises an infrared heater 10 having a vertically upright heating surface 12. A conveyor belt 14 has an upper flight 16 on which caps C are placed after logos have been ink-imprinted on their front surfaces FS. The belt is driven by a motor 18 such that the upper flight 16 continuously travels in a direction D, causing the caps C to slowly pass laterally across the heating surface 12. The speed of the belt 14 is regulated with the intent of causing the ink to be fully cured by the time that the respective caps have passed out of the heating zone located immediately in front of the heating surface 12.

Such an apparatus has exhibited a number of shortcomings, however. For example, the heating surface 12 lies in a vertical plane, whereas the front surface FS (and thus also the applied logo) of a typical athletic cap is curved as viewed from above (see FIG. 7). Accordingly, the horizontally spaced end regions of the logo will be spaced farther from the heating surface than the central horizontal region.

Furthermore, the front surface FS of a typical athletic cap is inclined at a slight angle A relative to a vertical plane V as viewed from the side (see FIG. 8). Consequently, the upper regions of the logo will be spaced farther from the heating surface than the lower regions of the logo.

The non-uniform spacing of the various regions of the logo relative to the heating surface 12 means that the curing of the various regions of the logo will occur at different rates. The implications of that fact become apparent when it is realized that each ink cures at a particular temperature, and that adverse effects occur if the heating is terminated either before or after the ink reaches its respective curing temperature. For example, ink which fails to reach the curing temperature will later tend to flake-off prematurely. On the other hand, ink which exceeds the curing temperature tends to reliquify and run, thereby blurring the appearance of the logo. Also, an overheated ink may tend to become undesirably darker in color.

It will, therefore, be appreciated that if the caps remain in front of the heater long enough for the horizontal end regions and upper regions thereof to reach the curing temperature, then the intermediate regions (which are located closer to the heating surface) may tend to become excessively heated. Conversely, if only the intermediate regions of the logo reach, but do not exceed, the curing temperature, then the horizontal end regions and upper regions of the logo may not be properly cured.

Moreover, the apparatus depicted in FIGS. 6 and 7 requires a belt and drive motor and thus is rather heavy and not easily portable. In that regard, it would be desirable to provide a readily portable device which could be taken to various sites, such as fairs and sporting events at which made-to-order logos could be applied to the caps at the site (in conjunction with a suitable printing device).

SUMMARY OF THE INVENTION

One aspect of the present invention involves a heating apparatus for curing an ink design applied to a curved front surface of a cap. The apparatus comprises a housing and a heating unit mounted on the housing. The heating unit includes a heating surface. A tray is mounted on the housing and is adapted to receive a cap having an ink design on a front surface thereof. The tray is movable between a remote zone and a heating zone situated immediately in front of the heating surface. The heating surface is configured such that horizontally spaced end portions thereof are offset forwardly relative to a horizontally intermediate portion thereof, whereby the heating surface generally conforms to a horizontal curvature of the front surface of the cap seated on the tray. A tray actuating mechanism is operably connected to the tray for displacing the tray into the remote zone after the tray has been in the heating zone for a preset ink-curing period of time.

Preferably, the heating surface includes an upper portion which is offset forwardly relative to a lower portion thereof so that the heating surface generally conforms to a vertical inclination of the front surface of the cap.

Preferably, the heating surface comprises two heating panels spaced apart horizontally and forming an obtuse angle therebetween as viewed from above. The horizontally intermediate portion of the heating surface is defined by horizontally spaced inner ends of respective ones of the heating panels. Each of the panels is inclined out of a vertical plane to cause an upper portion thereof to be offset forwardly relative to a lower portion thereof, whereby the heating surface generally conforms to a vertical inclination of the cap front surface.

Another aspect of the invention relates to the horizontally spaced end portions of the heating surface being offset forwardly relative to a horizontally intermediate portion of the heating surface, as well as the heating surface including an upper portion offset forwardly relative to a lower portion, whereby the heating surface generally conforms to a horizontal curvature, and a vertical inclination, of the cap front surface.

Yet another aspect of the invention relates to the provision of a tray mounted on the housing and adapted to receive a cap having an ink design applied to a front surface thereof. The tray is movable between a remote zone and a heating zone. The heating zone is disposed immediately in front of the heating surface. A tray actuating mechanism is operably connected to the tray for displacing the tray to the remote zone after the tray has been in the heating zone for a preset ink curing period of time.

BRIEF DESCRIPTION OF THE DRAWINGS

The objects and advantages of the invention will become apparent from the following detailed description of a preferred embodiment thereof in connection with the accompanying drawings in which like numerals designate like elements, and in which:

FIG. 7 is a top plan view of a prior art cap heater; and

FIG. 8 is a side elevational view of the prior art heater depicted in FIG. 7.

DETAILED DESCRIPTION OF A PREFERRED EMBODIMENT OF THE INVENTION

Figure 1:
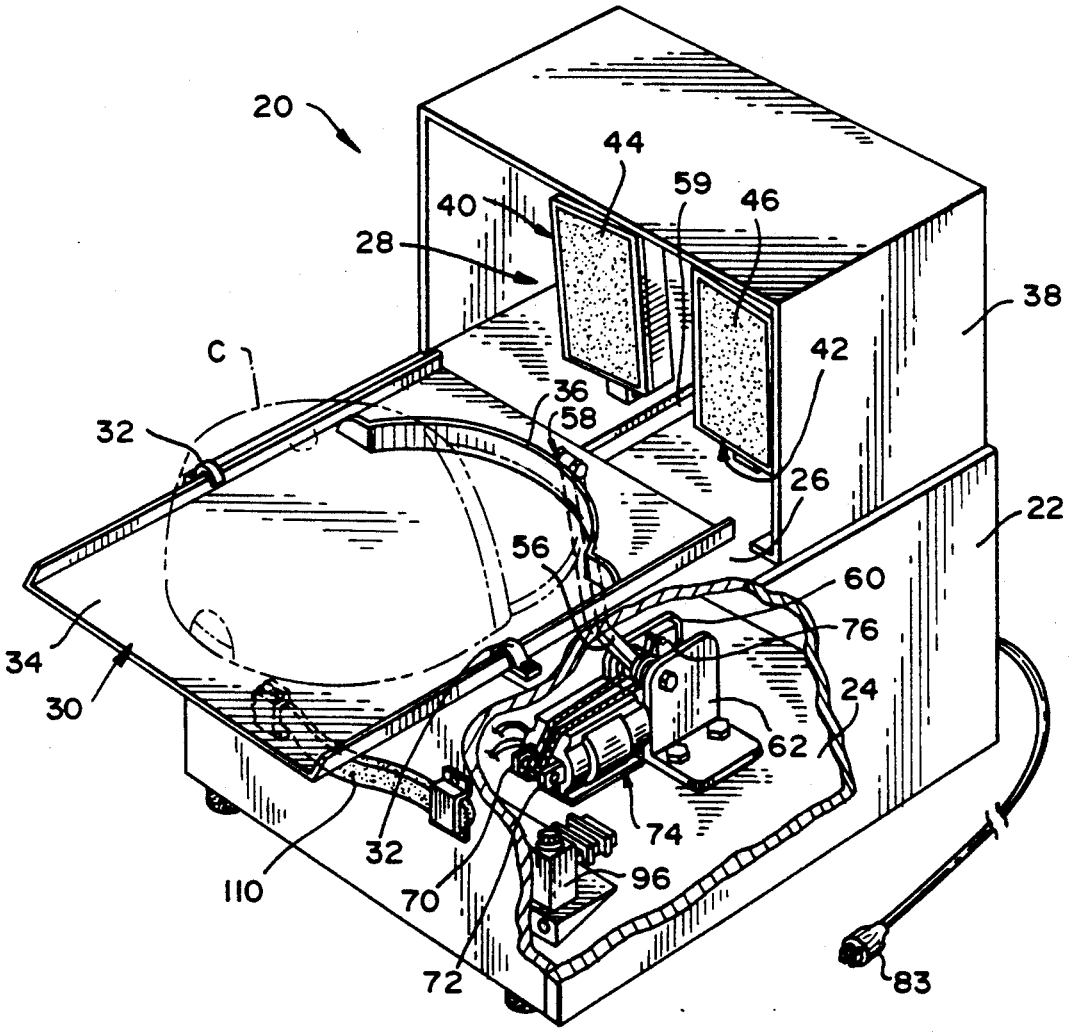
FIG. 1 is a top perspective view of a heater according to the present invention, with a wall of a housing thereof being broken away.
Figure 2:
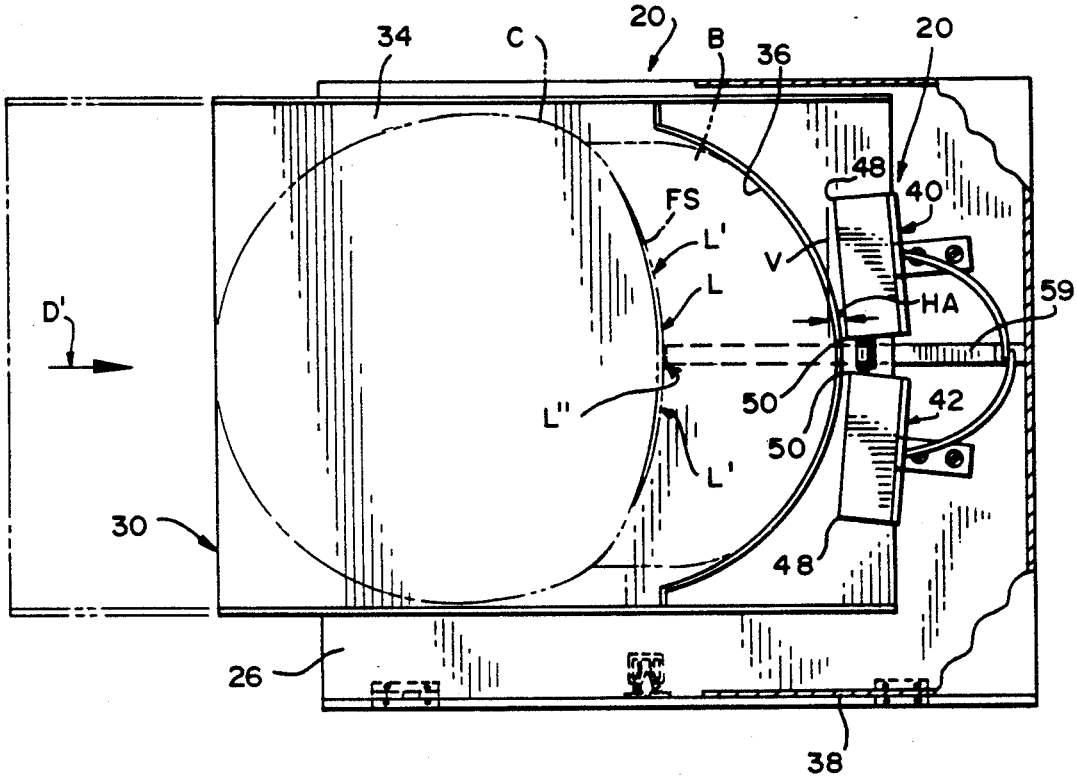
FIG. 2 is a top plan view of the heater depicted in FIG. 1, with a tray thereof being depicted in a heating zone in solid lines, and in a remote zone in broken lines.

A preferred ink-drying apparatus 20 according to the present invention is depicted in FIGS. 1-5. That apparatus comprises a base 22 having an interior chamber 24 and an upper work table 26. Mounted on the table 26 is a heating mechanism 28 and a slidable tray 30.

The tray 30 is guided for horizontal sliding movement on the table 26 by a pair of guide brackets 32 fastened to the table. The tray 30 is formed of a heat-resistant material, such as metal, and includes a flat surface 34, upon which a workpiece, such as an athletic cap C for example, can be placed.

Figure 3:
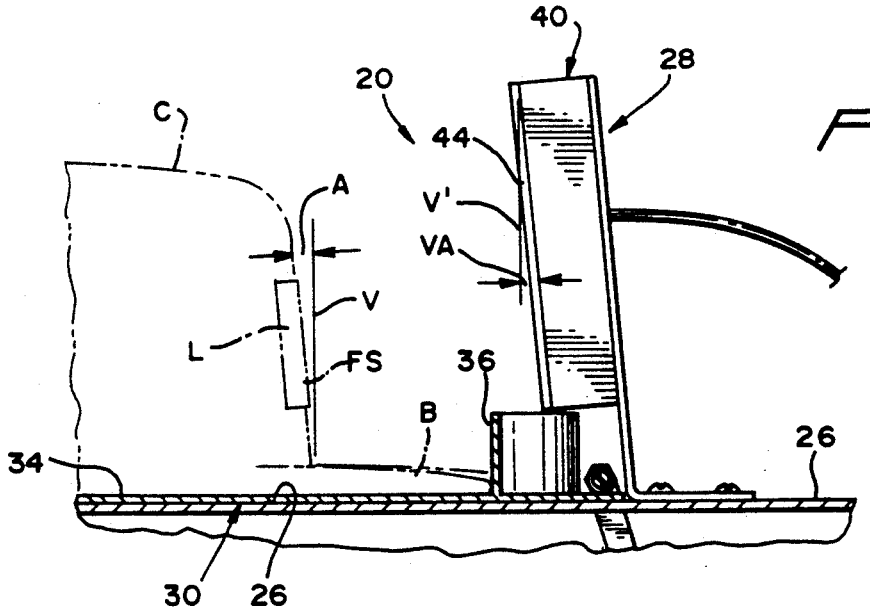
FIG. 3 is a fragmentary side elevational view of the heater depicted in FIG. 2.

The cap C includes a brim B and an upstanding front surface FS which is curved when viewed from above (see FIG. 2) and inclined at a slight angle A relative to a vertical plane V when viewed from the side (see FIG. 3). The tray 30 is provided at one end with a curved flange 36 against which the brim B of the cap may be placed. A metal shroud 38 encompasses the heating mechanism 28, the latter comprising one or more upstanding heating units. Preferably, two heating units 40, 42 are used, each unit comprising an infrared heater panel presenting a flat heating surface 44, 46. The heating surfaces 44, 46 are not coplanar, but rather are inclined relative to one another to form an obtuse angle therebetween as viewed from above (see FIG. 2). In particular, each heating surface 44, 46 forms an acute angle HA relative to a vertical plane V' oriented perpendicularly to a direction of tray movement D'. Due to the presence of that angle HA, the laterally outer portions 48 of the heating surfaces are offset forwardly relative to inner or intermediate portions 50 thereof. Consequently, the distance from the panel outer portions 48 to the front surface FS of the cap will be less than would be the case if the heating surfaces 44, 46 were oriented parallel to the plane V, and will more closely correspond to the distance from the panel intermediate ends 50 to the front surface FS. As a result, the laterally or horizontally outermost regions L' of a logo L imprinted on the front surface FS will be heated at a rate more closely corresponding to the rate of heating of the horizontally intermediate region C'' of the logo.

Consequently, the heating surface arrangement 44, 46 more closely conforms to the curvature of the front surface FS, as viewed from above, thereby enabling a more uniform rate of heating to occur horizontally across the logo.

The angle HA is preferably in the range of about 5° to 15° and is most preferably about 10°. Therefore, the obtuse angle formed between the two heating surfaces is in the range of 150° to 170° and most preferably is about 160°. The inner portions 50 of the heating surfaces are spaced horizontally apart to form a gap between the heater panels. The presence of that gap minimizes the possibility that the horizontally center region of the logo will be heated by both (overlapping portions) of the heating surfaces. Such a double heating could cause the logo central region to be overheated.

Furthermore, the heating surfaces 44, 46 are inclined at an acute angle VA relative to the vertical plane V' as viewed from the side (see FIG. 3) such that the top of the heating surface is offset forwardly relative to the bottom thereof. That inclination will cause the heating surfaces to more closely conform to the angle of inclination A of the front surface FS. As a result, the spacing between the logo and the heating surfaces will generally correspond along the height of the logo, whereby the logo will be heated at a substantially uniform rate along the logo height.

The angle VA is preferably in the range of about 5° to 15° and is most preferably about 10°.

The heating panels 40, 42 can be of any suitable type and preferably comprise infrared heaters, such as type ES manufactured by Casso-Solar Corp. of Pomona, N.Y. which operates at 115 volts, 60 cycle, 450 watts. For example, an energy output of between 15 and 20 watts per square inch for such heaters will achieve an emitter temperature of 1200° F., corresponding to a wavelength emission between 3.5 to 3.7 microns for curing a plastiol ink. The heating period can be selected to suit the particular ink being dried.

Since the heating panels may require a few minutes to fully heat up, it is usually preferable to keep the panels energized continuously. Consequently, there exists the risk that the ink will be underheated or overheated if the period in which the cap lies in the heating zone located immediately in front of the heating panels does not correspond to the prescribed heating period. In order to guard against that possibility, the present apparatus includes a mechanism for automatically displacing the cap out of the heating zone at the end of the prescribed heating period.

In that regard, the tray 30 is connected to the upper end of a lever 56 by means of a horizonal pivot pin 58. The lever 56 extends into the chamber 24 through a slot 59 in the table 26 and is connected to a pair of upright plates 60, 62 by means of a horizontal pivot pin 64. The lower portion of the lever 56 is arranged to oscillate within a space formed between the plates 60, 62 as the tray 30 reciprocates.

At its lower end, the lever 56 includes a vertical slot 66 in which is received a horizonal pin 68. The ends of the pin 68 are fixed to respective ones of a pair of horizontally spaced parallel bars 70, 72 which together form the reciprocating plunger of a conventional electric solenoid 74. The solenoid 74 functions such that when the solenoid is electrically energized, the plunger (i.e., bars 70, 72) is extended (i.e., displaced to the right in FIG. 4) so as to cause the lever 56 to rotate counterclockwise in FIG. 4 and displace the tray 30 to the left, away from the heating zone, as will be explained later in greater detail.

Attached to an inner side of one of the plates 60 is a conventional electric microswitch 76 having a finger 78 mounted at its upper end by a horizontal pivot. The finger 78 is biased outwardly (to the left in FIG. 4) by a spring 80.

Figure 4:
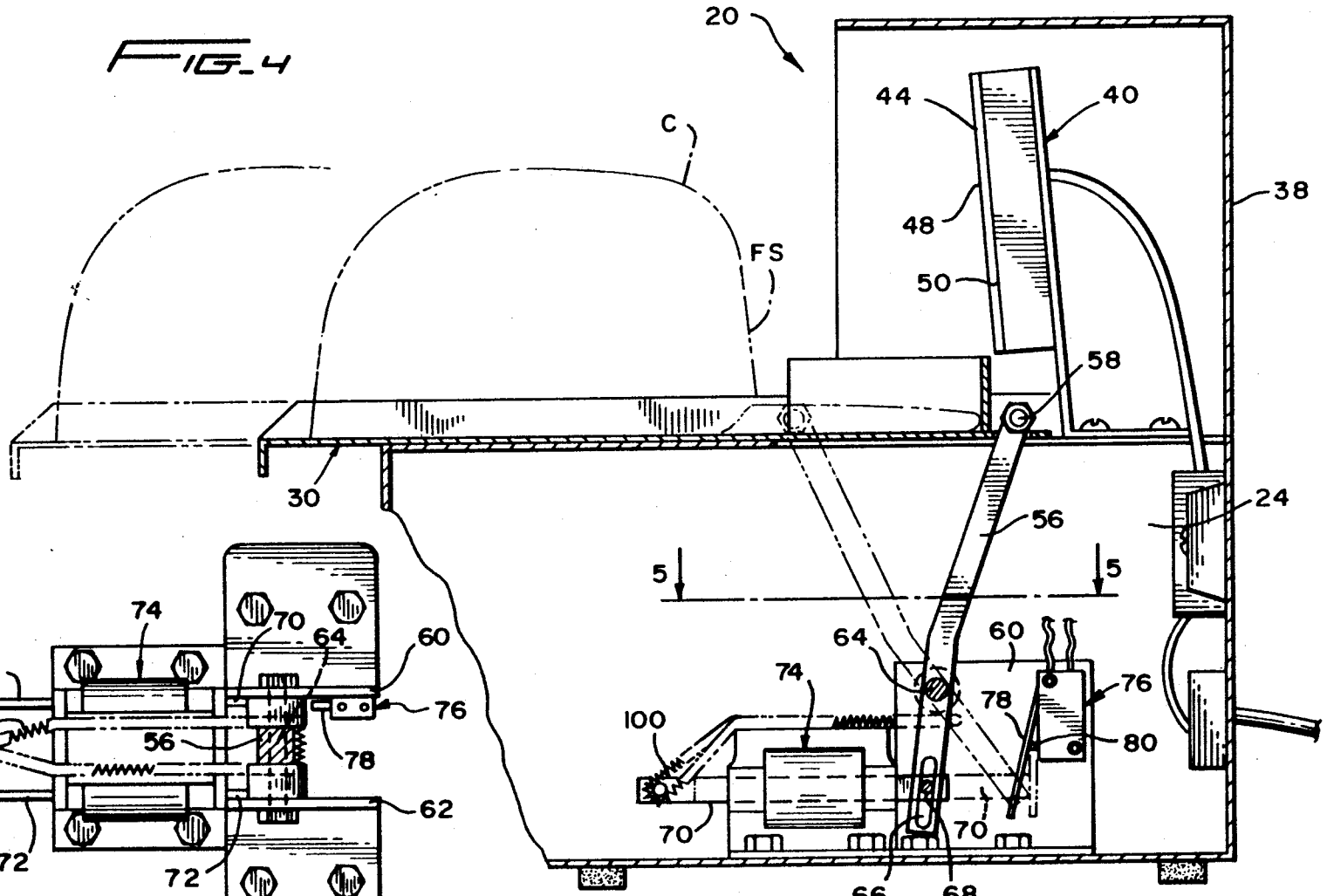
FIG. 4 is a vertical sectional view taken through the heater, wherein the tray is depicted in a heating zone in solid lines, and in a remote zone in broken lines.
Figure 5:
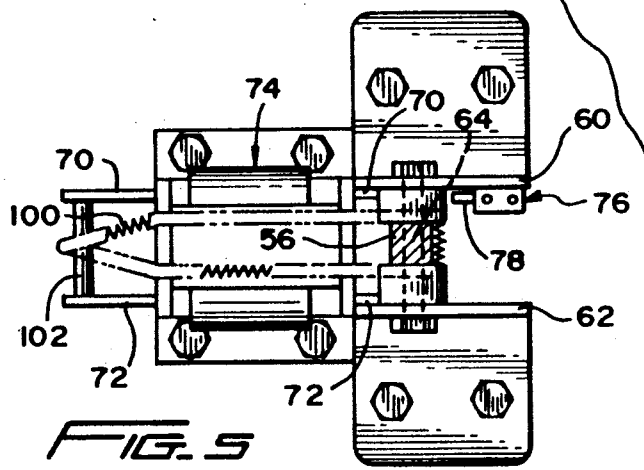
FIG. 5 is a sectional view taken along the line 5—5 in FIG. 4.

The finger 78 lies in the path of the bar 70 of the solenoid, so that when the solenoid is energized to extend the bars 70, 72 to the right in FIG. 4, the bar 70 causes the finger to pivot counterclockwise, as depicted in phantom in FIG. 4. That movement also causes the tray to be shifted away from the heating zone. On the other hand, when the tray 30 is being shifted (manually) into the heating zone (i.e., to the right in FIG. 4), the lever 56 rotates clockwise to displace the bars 70, 72 to the left, thereby allowing the finger 78 to pivot outwardly under the influence of the spring 80.

Figure 6:
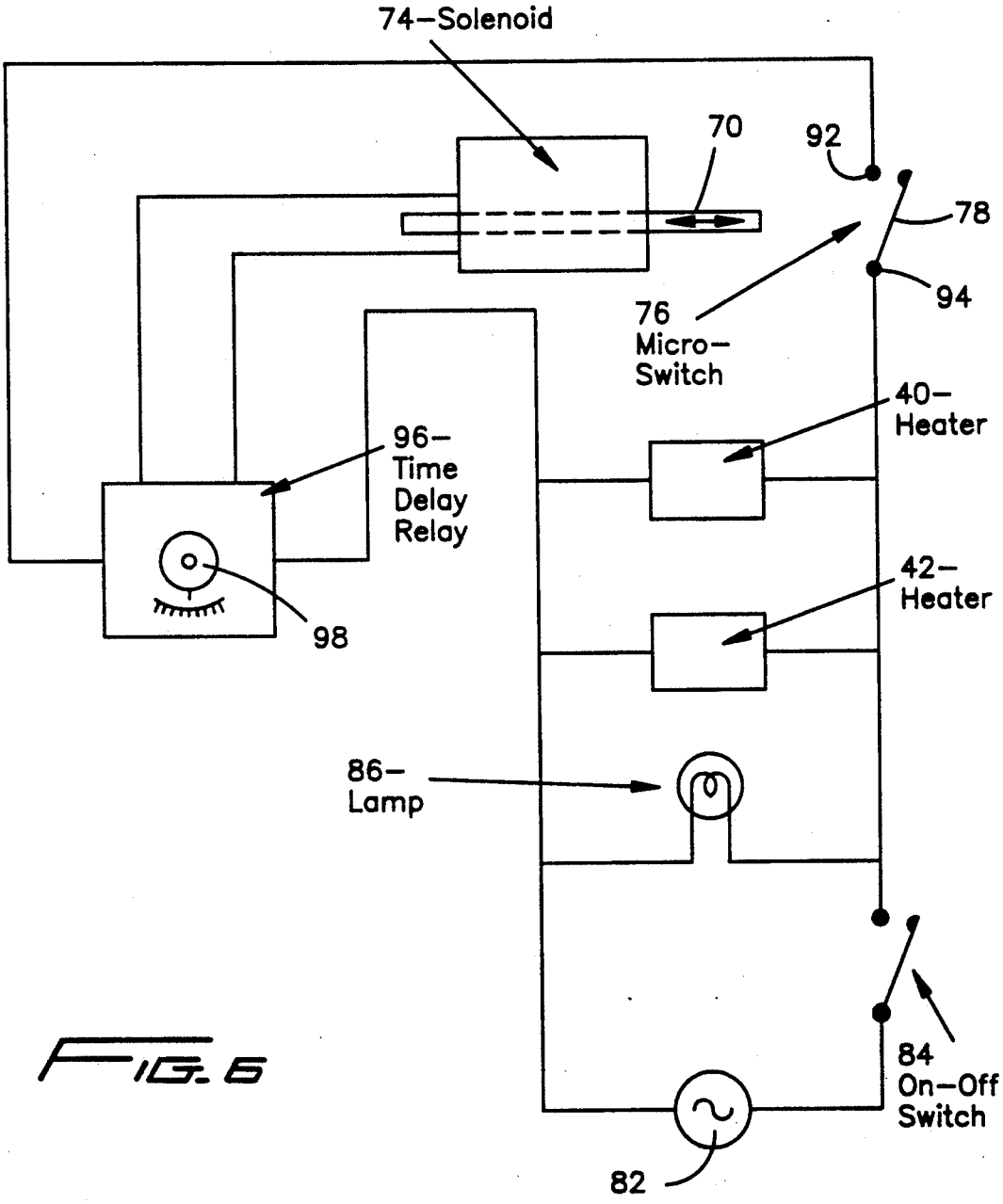
FIG. 6 is a schematic circuit diagram for actuating the present invention.

As depicted in FIG. 6, the microswitch is connected in an electric circuit. The circuit can be connected to a standard source of alternating current 82 by means of an electric plug 83. The circuit includes main On-Off switch 84 which, when manually closed, causes the heaters 40, 42 to be energized, along with a lamp 86 which indicates that the device is operational.

The sole function of the microswitch 76 and time delay relay 96 is to cause the tray 30 to be displaced out of the heating zone after a preset time period. In that regard, the finger 78 of the microswitch serves to open and close two contacts 92, 94 of the circuit. When those contacts are closed, a conventional time delay relay 96 is energized. That relay 96 is connected to the solenoid in order to energize the solenoid once a preset time period has elapsed following the moment that the relay 96 was energized. The extent of that time period, e.g. between six and sixty seconds, can be regulated by a manual adjustment dial 98.

The finger 78 of the microswitch is so arranged that when pivoted inwardly (i.e., to the right in FIG. 4), the contacts 92, 94 are opened, and when pivoted outwardly by the spring 80 (i.e., to the left in FIG. 4), the contacts 92, 94 are closed. Hence, when the tray 30 is pushed manually into the heating zone (i.e., to the right in FIG. 4), the lever 56 is rotated to pull the bar 70 away from the finger 78, allowing the finger to close the contacts 92, 94 and energize the relay 96. After the preset time period established by the relay, the relay causes the solenoid 74 to be energized, whereupon the bars 70, 72 are extended to the right in FIG. 4. That rightward movement of the bars 70, 72 causes: (i) the lever 56 to be rotated counterclockwise to the phantom-line position so as to displace the tray 30 out of the heating zone, and (ii) the finger 78 to open the contacts 92, 94 and thereby deactivate the solenoid. It will be appreciated that the heaters 40, 42 remain continuously energized as long as the On-Off switch 84 is in a closed state.

In order to dampen any vibrations occurring during rotation of the lever 56, a relatively weak coil spring 100 is wrapped around the lever 56 and a pin 102 which interconnects the rear ends of the solenoid plunger bars 70, 72.

In operation, an operator places upon the tray 30 a cap C which has just been imprinted with an ink logo L. The cap is positioned such that the brim B of the cap abuts against the flange 36 of the tray. The ON-OFF switch 84 has been previously actuated, whereby the heating panels 40, 42 are at their operative temperatures. The operator then manually pushes the tray 30 toward the heating panels and into the heating zone. In so doing, the lever 56 is caused to be rotated to the solid line position of FIG. 4, whereupon the spring 80 displaces the microswitch finger 78 to a position closing the contacts 92, 94. As a result, the time-delay relay is energized to establish a pre-set delay period during which the logo is heated. That time delay is set in accordance with the type of ink being used, in order to ensure that the ink of the logo is heated to its particular curing temperature but no higher. During the curing step, portions of the logo are heated at a substantially uniform rate, due to the angles HA and VA of the heating surfaces 54, 46 as viewed from above and side which causes the heating surfaces to generally conform to the inclination and curvature of the logo.

Following the afore-mentioned pre-set time delay, the solenoid 74 is energized, whereupon the solenoid plunger 70, 72 is extended to rotate the lever 56 in a manner displacing the tray 30 out of the heating zone. When the tray stops, the momentum of the cap causes the cap to slide rearwardly off the open rear end of the tray and into a collection container. When the solenoid plunger is extended, the bar 70 of the extended plunger displaces the finger 78 of the microswitch 76 to open the contacts 92, 94 and thereby de-energize the solenoid.

As a result of the present invention, the possibility that portions of the logo will be underheated or overheated are minimized. This is achieved by means of a light-weight unit which is readily portable, since no conveyors or conveyor motors are needed. In fact, a handle 110 located on a front wall of the unit facilitates manual carrying of the unit, so that the unit can be brought to events such as fairs, sporting events, etc., along with a printer, to enable caps to be printed on-site.

Although the present invention has been described in connection with a preferred embodiment thereof, it will be appreciated by those skilled in the art that additions, modifications, substitutions, and deletions not specifically described may be made without departing from the spirit and scope of the invention as defined in the appended claims.

What is claimed is:

1. A method of curing a plastiol ink design on a front surface of a cap, comprising the steps of:

A) providing an electrical infrared heating mechanism which presents a pair of heating surfaces angled with respect to one another to form an included obtuse angle therebetween, said obtuse angle being less than 180 degrees and lying in a substantially horizontal plane, each of said heating surfaces being inclined at an acute angle relative to vertical such that upper ends of said heating surfaces extend farther than lower ends thereof in the general direction in which said heating surfaces face, B) energizing said infrared heaters to produce infrared radiation having a wave length in a range of from 3.5 to 3.7 microns;

C) manually positioning a cap upon a top surface of a substantially horizontal tray such that:

C1) a bottom portion of said cap lies on said top surface,

C2) a portion of said cap engages a locating element which projects upwardly from said top surface, and C3) a front portion of said cap, which contains a design formed of an uncured plastiol ink, faces said heating surfaces and is oriented such that an upper end of said front portion is inclined upwardly away from said heating surfaces, and lateral ends of said front portion are inclined horizontally away from said heating surfaces;

D) sliding said tray substantially horizontally inwardly toward said heating surfaces subsequent to said energizing step such that:

D1) said ink design is exposed to said infrared radiation from said heating surfaces, and D2) said cap is positioned relative to said heating surfaces such that the inclination of said heating surfaces relative to vertical generally conforms to the upward inclination of said front portion of said cap, and said relative angling of said heating surfaces relative to one another generally conforms to the horizontal inclination of said horizontal ends of said front face;

E) actuating a timer to be automatically activated in response to the sliding-in of said tray, said timer being set for a period corresponding to a curing period of said ink; and F) actuating a tray-actuating mechanism automatically at the end of the timed curing period for sliding said tray outwardly and away from said heating surfaces.

2. A method according to claim 1, wherein step C2 comprises positioning said cap on said top surface such that a curved front edge of a brim of said cap engages said locating element which is in the form of a curved flange.

3. A method according to claim 2, wherein step F comprises actuating an electric solenoid.

4. A method according to claim 3, wherein step A comprises providing an infrared heating mechanism wherein said obtuse angle is from 150 to 170 degrees.

5. A method according to claim 4, wherein step A comprises providing an infrared heating mechanism wherein said acute angle is from 5 to 15 degrees.

* * * * *